US007014594B2

(12) United States Patent
Stoltz

(10) Patent No.: US 7,014,594 B2
(45) Date of Patent: Mar. 21, 2006

(54) LADDER CLIMBING SAFETY SYSTEM

(76) Inventor: Matthew H. Stoltz, 300 E. 54th St., New York, NY (US) 10022

( * ) Notice: Subject to any disclaimer, the term of this patent is extended or adjusted under 35 U.S.C. 154(b) by 326 days.

(21) Appl. No.: 10/441,836

(22) Filed: May 19, 2003

(65) Prior Publication Data

US 2004/0235619 A1 Nov. 25, 2004

(51) Int. Cl.
*A63B 7/02* (2006.01)

(52) U.S. Cl. ..... 482/24; 482/34; 482/37; 482/38; 182/5; 182/133

(58) Field of Classification Search ..... 482/23, 482/24, 33–37, 43, 143; 182/5–8, 133; 472/92
See application file for complete search history.

(56) References Cited

U.S. PATENT DOCUMENTS

| | | | | |
|---|---|---|---|---|
| 3,177,543 | A * | 4/1965 | Fountain | 188/65.2 |
| 3,379,439 | A * | 4/1968 | Sorenson et al. | 482/25 |
| 3,908,791 | A * | 9/1975 | Kleine et al. | 182/8 |
| 4,034,828 | A * | 7/1977 | Rose et al. | 182/5 |
| 4,159,044 | A * | 6/1979 | Wydra | 182/3 |
| 4,942,943 | A * | 7/1990 | Flaherty | 182/231 |
| 5,067,585 | A * | 11/1991 | Bell | 182/7 |
| 5,178,590 | A * | 1/1993 | Stephens | 482/43 |
| 5,636,704 | A | 6/1997 | Castaneda | |
| 6,283,455 | B1 | 9/2001 | Ascherin et al. | |
| 6,473,944 | B1 | 11/2002 | Vazin | |
| 6,698,544 | B1 * | 3/2004 | Kurtgis | 182/3 |
| 2002/0112916 | A1 * | 8/2002 | Ador | 182/5 |

FOREIGN PATENT DOCUMENTS

JP 10184256 A * 7/1998

OTHER PUBLICATIONS

Internet printout dated Mar. 20, 2003 showing Ascenders; REI website.
Internet printout dated Apr. 20, 2003 showing Wild Country Ropeman II Ascender; REI website.

* cited by examiner

*Primary Examiner*—Jerome W. Donnelly
*Assistant Examiner*—Victor K. Hwang
(74) *Attorney, Agent, or Firm*—Frishauf, Holtz, Goodman & Chick, P.C.

(57) ABSTRACT

Ladder climbing safety system for use with a trapeze set-up and which is separate and apart from the usual trapeze safety system. The ladder climbing safety system is arranged to engage a safety belt worn by the trapeze artist to prevent the person from falling when climbing the ladder while the trapeze safety system is arranged to engage the safety belt of another person to prevent the other person from impacting the ground while performing a trapeze routine. The ladder climbing safety system includes an ascending rope arranged proximate the ladder, an ascender attachable to the ascending rope and a coupling arrangement for releasably connecting the ascender to the safety belt of the person climbing the ladder.

20 Claims, 2 Drawing Sheets

LADDER CLIMBING SAFETY SYSTEM

FIELD OF THE INVENTION

The present invention relates generally to a ladder climbing safety system and method and more particularly to a ladder climbing safety system and method for use by trapeze artists.

BACKGROUND OF THE INVENTION

The need for safety systems for trapeze artists is of paramount importance in view of the elevated height at which the trapeze artist performs his/her routine. Generally, the trapeze artist fastens a safety belt or harness around their waist and a safety rope is attached to the safety belt. The safety rope is wound over a pulley situated above the swings and platforms used by the trapeze artist and held at its other end by a person. The person controls the appropriate amount of slack in the rope to enable the trapeze artist to perform his routine while preventing the trapeze artist from impacting the ground in the event the trapeze artist falls from the swings or platforms. A net is also usually positioned below the swings and platforms to catch the trapeze artist in the event of a fall. The safety rope is held at its free end by a person who continuously adjusts the length of the safety rope to reduce excess slack in the rope so as to allow the trapeze artist to fall safely into the net, while avoiding injury due to excess slack in the rope just prior to a fall.

The trapeze artist must often climb a ladder to reach the level of a trapeze platform from which he or she can begin a routine. To ensure the safety of the trapeze artist when climbing the ladder, the safety rope is connected to the safety belt worn by the trapeze artist as the trapeze artist begins the ascent up the ladder. In this manner, the trapeze artist is connected to the safety rope from the moment he or she climbs the ladder to the end of the routine.

When the trapeze swings and platforms are to be used by numerous trapeze artists, such as in a training situation or camp, it is a drawback that the trapeze artist must be connected to the same safety rope while climbing the ladder as when performing the routine. Since, in conventional systems, the same safety system is used for both climbing the ladder and when performing the routine, the next using the system must wait until the prior person completes his/her routine before the next person can begin climbing the ladder to reach a position ready to start his or her routine immediately. This slows down the training operation and severely limits the number of people who can use the equipment in a given period of time.

OBJECTS AND SUMMARY OF THE INVENTION

It is an object of the present invention to provide a new ladder climbing safety system.

It is another object of the present invention to provide a new ladder climbing safety system and method for use by trapeze artists which is separate from the safety system used by the trapeze artists when performing their routines and thereby allows one person to climb up the ladder while another is performing a routine, thereby enabling more users to use the equipment in a given period of time.

It is still another object of the present invention to provide a new ladder climbing system and method which enables a series of people to sequentially climb the ladder to a desired elevation using a common safety system.

It is yet another object of the present invention to provide a new trapeze system and method for using the same which increases the ability of a series of people to sequentially use the trapeze system.

In order to achieve these objects and others, a trapeze system in which a ladder safety system in accordance with the invention is used includes a frame, a pedestal board, a suspension system for suspending the pedestal board from the frame, a ladder suspended either directly or indirectly from the frame and having a portion proximate the pedestal board, a safety belt adapted to be worn by a person and a trapeze safety system arranged to engage the safety belt to prevent the person from impacting the ground while the trapeze safety system is engaged with the safety belt. The ladder safety system is arranged to engage the safety belt to prevent the person from falling when climbing the ladder while the ladder safety system is engaged with the safety belt.

The ladder safety system is separate and apart from the trapeze safety system so that after climbing up the ladder with the ladder safety system engaged with the safety belt, the safety belt is disengaged from the ladder safety system and engaged with the trapeze safety system. In this manner, while one person is engaged with the trapeze safety system another person can be engaged with the ladder safety system and climb the ladder while the one person is performing a routine.

In one embodiment, the ladder safety system includes an ascending rope arranged proximate the ladder, an ascender attachable to the ascending rope and a coupling for connecting the ascender to the safety belt. The ascender allows movement only in an ascending direction. The coupling includes a safety line, a first releasable connector, such as a carabiner, which connects the safety line to the ascender and a second releasable connector, such as a carabiner, which connects the safety line to the safety belt. In use, after climbing up the ladder with the coupling unit connected to the ascender and the safety belt, the coupling unit is disconnected from the safety belt, the ascender is detached from the ascending rope and one of the releasable connectors is attached to the ascending rope such that the coupling with the ascender slides down the ascending rope.

Instead of sliding the coupling and ascender connected thereto down the ascending rope, an additional rope can be provided within reach of a person situated on the pedestal board or on the ladder near the pedestal board.

Using a ladder climbing safety system in accordance with the invention, a method for enabling a series of people to climb a ladder to a desired elevation comprises attaching a safety belt around each person, arranging an ascending rope retained at an upper region alongside the ladder, removably attaching an ascender to the ascending rope, and connecting the safety belt of a first person to the ascender via a coupling such that the first person is able to climb the ladder while the ascender is attached to the ascending rope. When the first person has reached the desired elevation, the coupling is disconnected from the safety belt, the ascender is detached from the ascending rope and the coupling with the ascender connected thereto is attached to a rope (which may be the ascending rope or another additional rope). The coupling with the ascender connected thereto is then slid down the rope for use by the next person.

When used for a trapeze system, when the first person has reached the pedestal board, the trapeze safety system is also engaged to the safety belt after the coupling has been disconnected from the safety belt.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE PREFERRED EMBODIMENTS

Figure 4:
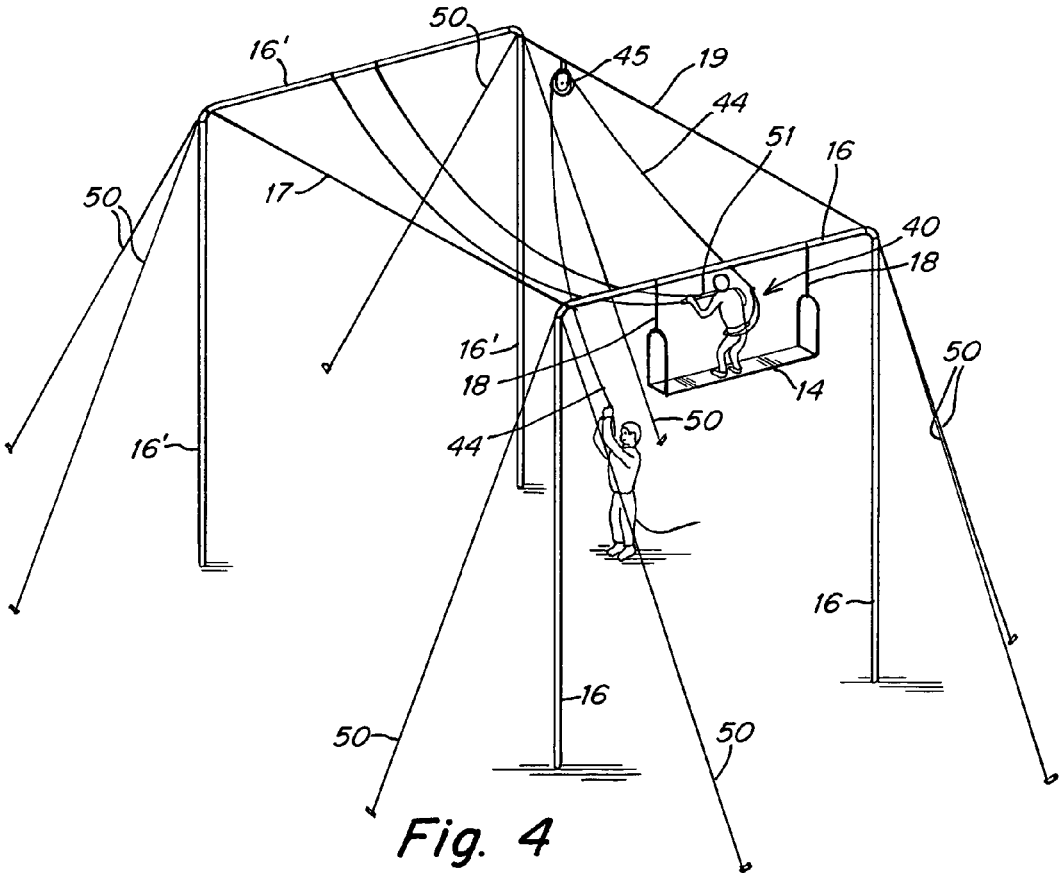
FIG. 4 shows two frames of a trapeze system in which the present invention is usable.

Referring to the drawings wherein like reference numerals refer to the same or similar elements, a ladder climbing safety system in accordance with the invention is designated generally at 10 and is used to prevent people climbing a ladder 12 from falling to the ground and being injured. As shown, ladder 12 is of the type used to enable people to reach a pedestal board 14 on which a trapeze artist would begin a routine and which is suspended from a frame 16 defining the trapeze set-up by suspension ropes 18. The ladder 12 may be a rope ladder or any other type of suitable ladder. The upper end of the ladder 12 is attached to the frame 16. The pedestal board 14 is suspended from the frame 16 by ropes or metal cables. The frame 16 is anchored to the ground and is maintained in its upright position by guy wires or cables 50 which are anchored to the ground. Only a portion of the frame 16 is shown and the trapeze set-up may include additional support ropes, pedestal boards, platforms and swings, as well as additional frames 16', as shown, for example, in FIG. 4. The frame 16' in FIG. 4 has a trapeze swing 51 connected thereto by ropes. The ladder climbing and safety system is not shown in FIG. 4 for clarity. In actual practice, additional frames like frames 16 and 16' are preferably used. Although the invention is shown used in connection with a ladder for reaching a trapeze platform, the invention can be used in other contexts to provide safety when climbing ladders to elevated platforms, such as for roofing ladders, scaffolding ladders, diving platform ladders, and the like.

Figure 1:
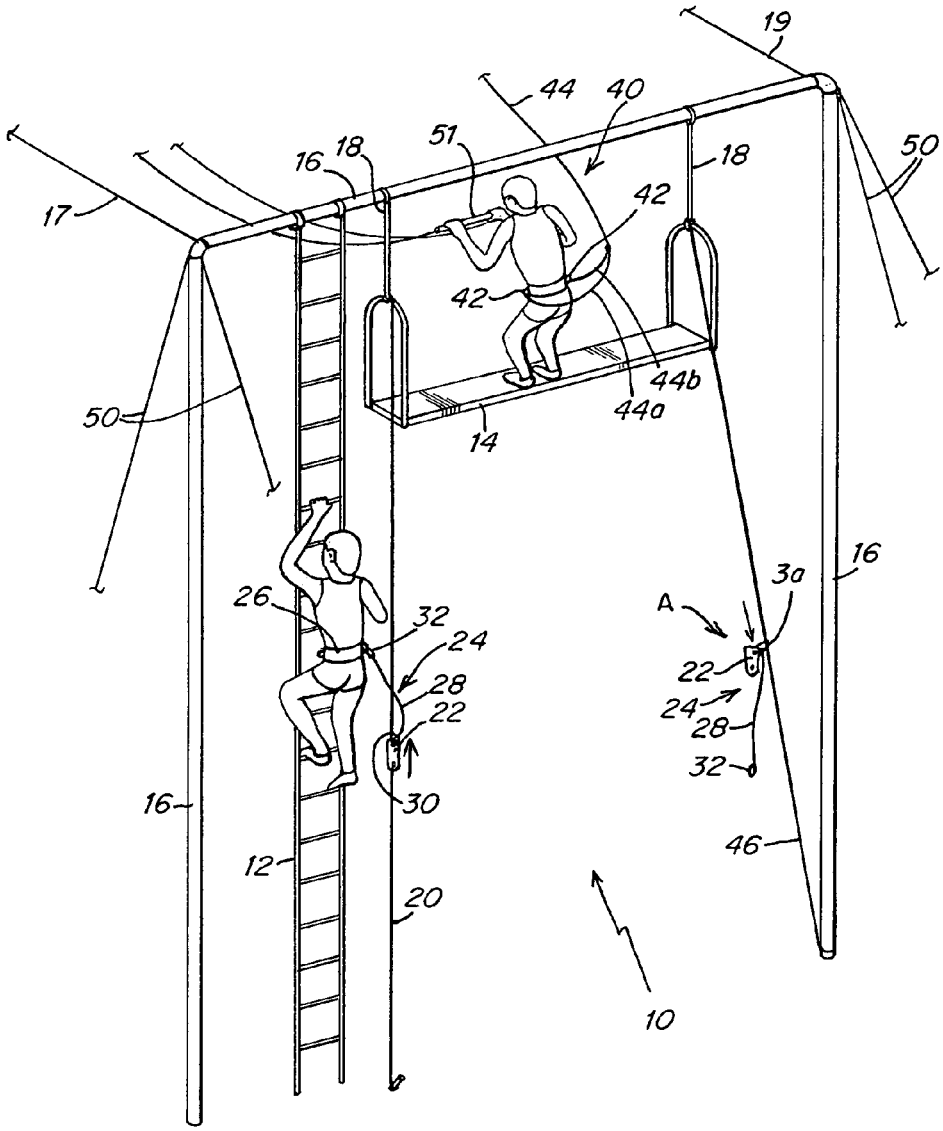
FIG. 1 is a perspective view of a ladder climbing safety system in accordance with the invention shown for use in connection with a trapeze set-up.

The ladder climbing safety system 10 includes an ascending rope 20 attached at an upper region to one of the ropes 18 suspending the pedestal board 14 or to another member of the pedestal board. The upper region of the ascending rope 20 could also be attached to a different part of the frame 16 but to enable use of the invention, a portion of the ascending rope 20 should be within reach of a person on the pedestal board 14 or on the ladder 12 near the pedestal board 14 so that this person will be able to reach the ascending rope 20 for purposes explained in detail below. Thus, the ascending rope 20 is preferably arranged proximate the ladder 12 as shown in FIG. 1. The lower end of the ascending rope 20 is preferably fixed to the ground or held while a person is ascending the ladder 12.

Figure 2:
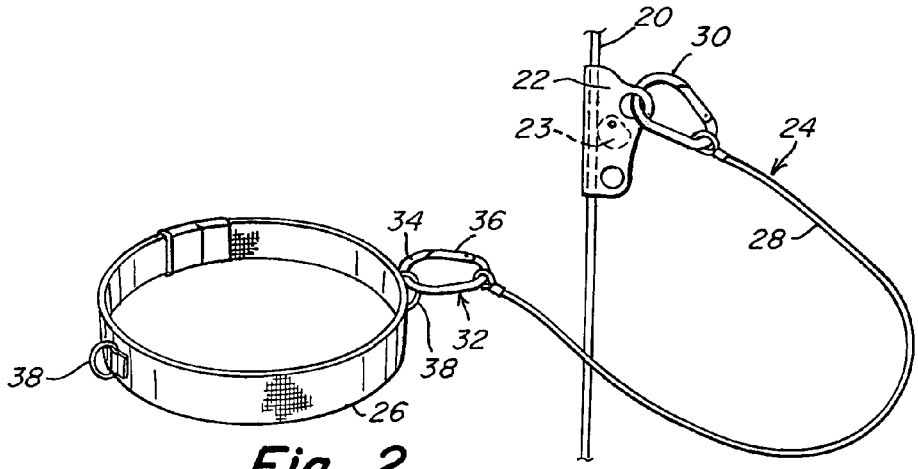
FIG. 2 is an enlarged view showing more details of the ladder climbing safety system in accordance with the invention.
Figure 3:
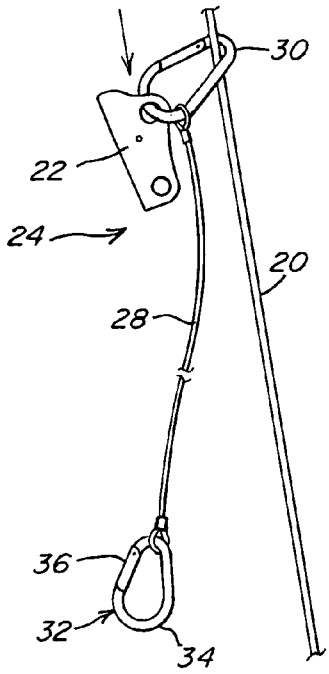
FIG. 3 is an exploded view of the portion designated A in FIG. 1.

The ladder climbing safety system 10 also includes an ascender 22 movably attached to the ascending rope 20 and a coupling 24 for connecting the ascender 22 to a safety belt 26 worn by the person climbing the ladder 12. See FIG. 2.

The ascender 22 is an implement used by climbers (i.e., mountain climbers) for attaching themselves to ropes via carabiners and optional safety lines. The ascender 22 is spring-loaded and is constructed to allow movement only in one direction, i.e., the ascending direction when properly attached. The ascender 22 includes a spring loaded pivotal cam 23 (FIG. 2) which bears against the ascending rope 20. Thus, the ascender 22 cannot move downward on the ascending rope 20 and therefore prevents a climber attached to the ascender 22 from falling. The ascender 22 used in the invention may be any known ascender used in the climbing art which allows a carabiner or similar clasp or releasable connector to be attached thereto. A typical ascender for use in the present invention is the Wild Country Ropeman II Ascender, item, No. 651365, available from REI (www.RE-I.com).

The coupling 24 includes an elongated safety line 28, which may be made of rope or a comparably strong material, and two releasable connectors, such as carabiners 30,32, one fixed to each end of the safety line 28. One carabiner 30 removably attaches the coupling 24 to the ascender 22 and the other carabiner 32 removably attaches the coupling 24 to the safety belt 26.

The carabiners 30,32 are known implements in the climbing art and typically have an oblong loop 34 of rigid material such as steel and a spring-loaded flap 36 which is pressed inward as the carabiner 30,32 is attached to a rope and springs backs once the rope is situated in the loop 34. Thus, the loop 34 defines an interior space larger than the cross-section of the rope to which the carabiner 30,32 is to be attached so that the carabiners 30,32 can slide along the rope.

The safety belt 26 includes one or more D-rings 38 (or other shaped rings or hooks) to which the carabiner 32 attaches. The safety belt 26 also includes a clasping device such as a buckle to enable it to be securely attached around the person.

To use the ladder climbing safety system 10, a person attaches the safety belt 26 around their waist and clips the coupling 24 to the safety belt 26 via the carabiner 32. Either before or after the coupling 24 is clipped to the safety belt 26 via the carabiner 32, the carabiner 30 is attached to the ascender 22 which is situated within reach at the bottom of the ascending rope 20. The person begins to climb the ladder 12 and as he/she climbs the ladder 12, the ascender 22 is moved up the ascending rope 20.

Safety is provided for the person against falling because if the person should lose his/her grip on the ladder 12 and become detached from the ladder 12, the person will hang from the ascending rope 20 via the ascender 22 and coupling 24. The ascender 22 cannot move downward on the ascending rope 20 so the person will hang until he/she can regain his/her grip on the ladder 12 in view of the proximity of the ascending rope 20 to the ladder 12. The safety line (rope) 28 is preferably relatively short, i.e., between about 3 and 6 feet long, and preferably between about 3 and 4 feet long.

When the person climbing the ladder reaches the pedestal board 14, the person engages the trapeze safety system 40 with the safety belt 26 via the D-rings 38. This involves attaching a pair of clips 42 on the safety rope 44 of the trapeze safety system to the D-rings 38 on the safety belt 26. The clips 42 are connected at the ends of the branches 44*a*, 44*b* of the safety rope 44. Once the clips 42 are attached to the D-rings 38, the person disconnects the coupling 24 from the safety belt 26, i.e., detaches the carabiner 32 from the D-ring 38 on the safety belt 26, and the person is then ready to perform the trapeze routine while connected to the safety rope 44.

Since the person performing the trapeze routine is connected to the trapeze safety system 40 and is no longer connected to the ladder climbing safety system 10, another person can climb the ladder 12 and be protected by the ladder climbing safety system 10. This increases the speed at which successive people can use the trapeze swings and platforms since there is little or no downtime, i.e., someone can always be performing a trapeze routine as someone else is climbing the ladder 12 to reach the pedestal board 14 and prepare to perform a routine after the preceding person has finished. Thus, a series of people can more efficiently use the trapeze set-up in an expeditious and safe manner.

The ladder safety system 10 is thus separate and apart from the trapeze safety system 40 in that its components are not also part of the trapeze safety system 40.

To enable the next person to climb the ladder 12 while being protected by the ladder climbing safety system 10, when the carabiner 32 is disconnected from the D-ring 38, the ascender 22 and coupling 24 connected thereto (via carabiner 30) must be lowered to the ground. It is not possible to simply force the ascender 22 down the ascending rope 20 because it is designed to prevent movement in the downward direction.

In accordance with the invention therefore, the ascender 22 is detached from the ascending rope 20 and one of the carabiners 30,32 is attached to the ascending rope 20. The carabiners 30,32 have a sufficiently large loop relative to the diameter of the rope 20 and do not impede movement along the rope 20 in either direction. Therefore, the coupling 24 and connected ascender 22 can slide along the ascending rope 20 to the ground once one of the carabiners 30,32 is attached around the ascending rope 20. Once the coupling 24 and ascender 22 reach the ground, the carabiner 30,32 is detached from the ascending rope 20, the ascender 22 is attached to the ascending rope 20 and the carabiner 32 is attached to a D-ring 38 on the safety belt 26 of the next person. The next person can now safely climb the ladder. This all occurs while the person who previously climbed the ladder 12 is performing a trapeze routine.

Preferably, instead of having the coupling 24 and connected ascender 22 slide to the ground on the ascending rope 20, a separate rope 46 may be provided alongside or proximate the ascending rope 20 and used to enable the coupling 24 and connected ascender 22 to slide to the ground. In this case, if multiple ascenders 22 and couplings 24 are provided, a person can be moving up the ladder 12 with his/her ascender 22 connected to the ascending rope 20 while the ascender 22 and coupling 24 used by the preceding person is being passed down on the separate rope 46. This further speeds the use of the trapeze system. In FIG. 1, the separate rope 46 for lowering a coupling 24 to the ground is shown on the right side of the pedestal board for ease of illustration and clarity of understanding. The rope 46 may be connected adjacent to the rope 20 or at any other position within reach of a person on the pedestal board.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A trapeze system, comprising:

a frame;

a pedestal board;

suspension members for suspending said pedestal board from said frame;

a ladder suspended from said frame and having a portion proximate said pedestal board;

a safety belt adapted to be worn by a person;

a trapeze safety system arranged to engage said safety belt to prevent the person from impacting the ground while said trapeze safety system is engaged with said safety belt; and a ladder safety system arranged to engage said safety belt to prevent the person from falling when climbing said ladder while said ladder safety system is engaged with said safety belt, said ladder safety system being separate and apart from said trapeze safety system, whereby after climbing up said ladder with said ladder safety system engaged with said safety belt, said safety belt is disengaged from said ladder safety system and engaged with said trapeze safety system.

2. The system of claim 1, wherein said ladder safety system comprises an ascending rope coupled at an upper region to one of said suspension members.

3. The system of claim 2, wherein said upper region of said ascending rope is arranged proximate said ladder.

4. The system of claim 2, wherein said ladder safety system comprises an ascender attachable to said ascending rope and a coupling for connecting said ascender to said safety belt, said ascender being arranged to allow movement only in an ascending direction.

5. The system of claim 4, wherein said coupling comprises a safety line, a first carabiner for connecting said safety line to said ascender and a second carabiner for connecting said safety line to said safety belt.

6. The system of claim 5, wherein said first and second carabiners are arranged to define an aperture larger than the cross-section of said ascending rope such that said first and second carabiners are slidable down said ascending rope, whereby after climbing up said ladder with said coupling connected to said ascender and said safety belt, said coupling is disconnected from said safety belt, said ascender is detached from said ascending rope and one of said carabiners is attached to said ascending rope such that said coupling with said ascender slides down said ascending rope.

7. The system of claim 6, further comprising an additional rope having a portion proximate said pedestal board whereby when said coupling is disconnected from said safety belt and said ascender is detached from said ascending rope, said first and second carabiners are attachable to said additional rope to enable said coupling with said ascender to slide down said additional rope.

8. The system of claim 5, wherein said safety belt includes a D-ring member, said second carabiner being attachable to said D-ring member.

9. A method for enabling a series of people to climb a ladder to a desired elevation, comprising attaching a safety belt around each person;

arranging an ascending rope retained at an upper region alongside the ladder;

removably attaching an ascender to the ascending rope, the ascender only allowing movement in an upward direction along the ascending rope;

providing a coupling for coupling the ascender to the safety belt;

connecting the safety belt of a first person to the ascender via the coupling such that the first person is able to climb the ladder while the ascender is attached to the ascending rope;

when the first person has reached the desired elevation, disconnecting the coupling from the safety belt, and detaching the ascender from the ascending rope;

attaching the coupling with the ascender connected thereto to a rope; and sliding the coupling with the ascender connected thereto down the rope for use by the next person.

10. The method of claim 9, wherein the coupling includes a safety line, a first carabiner for connecting the safety line to the ascender and a second carabiner for connecting the safety line to said safety belt.

11. The method of claim 10, wherein the step of attaching the coupling to the rope comprises the step of attaching one of the first and second carabiners to the rope.

12. The method of claim 10, wherein the first and second carabiners are arranged to define an aperture larger than the cross-section of the rope such that the first and second carabiners are slidable down the rope.

13. The method of claim 9, wherein the rope which the coupling is attached to and slides down is the ascending rope.

14. The method of claim 9, wherein the rope which the coupling is attached to and slides down is an additional rope separate from the ascending rope.

15. A method for enabling a series of people to climb a ladder to a pedestal board suspended by suspension ropes from a frame of a trapeze set-up and connect to a trapeze safety system, comprising the steps of:

attaching a safety belt around each person;

arranging an ascending rope retained at an upper region alongside the ladder;

removably attaching an ascender to the ascending rope, the ascender only allowing movement in an upward direction along the ascending rope;

providing a coupling for coupling the ascender to the safety belt;

connecting the safety belt of a first person to the ascender via the coupling such that the first person is able to climb the ladder to the pedestal board while the ascender is attached to the ascending rope;

when the first person has reached the pedestal board, disconnecting the coupling from the safety belt, detaching the ascender from the ascending rope, and engaging the trapeze safety system with the safety belt;

attaching the coupling with the ascender connected thereto to a rope; and sliding the coupling with the ascender connected thereto down the rope for use by the next person.

16. The method of claim 15, wherein the coupling includes a safety line, a first carabiner for connecting the safety line to the ascender and a second carabiner for connecting the safety line to said safety belt.

17. The method of claim 16, wherein the step of attaching the coupling to the rope comprises the step of attaching one of the first and second carabiners to the rope.

18. The method of claim 15, further comprising the step of attaching the upper end of the ascending rope to a suspension rope.

19. The method of claim 15, wherein the rope which the coupling slides down is the ascending rope.

20. The method of claim 15, wherein the rope which the coupling slides down is an additional rope separate from the ascending rope.

* * * * *